US005702206A

United States Patent [19]

Quenan et al.

[11] Patent Number: 5,702,206

[45] Date of Patent: Dec. 30, 1997

[54] OFFSHORE SUPPORT STRUCTURE METHOD AND APPARATUS

[75] Inventors: Gary O. Quenan, Houston; Tommy Lee Hull, Sugar Land, both of Tex.

[73] Assignee: OPE, Inc., Houston, Tex.

[21] Appl. No.: 615,873

[22] Filed: Mar. 14, 1996

[51] Int. Cl.[6] ..... E01B 17/00; E02D 31/00

[52] U.S. Cl. ..... 405/227; 166/338; 405/195.1; 405/204

[58] Field of Search ..... 405/227, 224, 405/225, 226, 203, 204, 207, 208, 195.1; 166/338–346, 351, 359, 367

[56] References Cited

U.S. PATENT DOCUMENTS

| | | | |
|---|---|---|---|
| 3,224,204 | 12/1965 | Siebenhausen | 405/227 |
| 3,516,259 | 6/1970 | Tokola | 405/208 |
| 3,546,885 | 12/1970 | Pogonowski . | |
| 3,624,702 | 11/1971 | Meheen . | |
| 3,670,507 | 6/1972 | Mott et al. . | |
| 4,557,629 | 12/1985 | Meek | 405/204 |
| 4,740,107 | 4/1988 | Casbarian et al. | 405/211 |
| 4,818,145 | 4/1989 | Carruba | 405/203 |
| 4,842,446 | 6/1989 | Carruba | 405/227 |
| 4,932,811 | 6/1990 | Folding | 405/227 |
| 4,983,074 | 1/1991 | Carruba | 405/227 |

OTHER PUBLICATIONS

"Minimal Platforms Booming in Shallow U.S. Gulf Waters", pp. 22–28, Offshore, Nov. 1988.

"Minimum Offshore Structures Cost Less, Pose Higher Risk", pp. 33–42 Oil and Gas Journal, OGJ Special Issue, Jul. 17, 1995.

"Bracel Caisson Structures", 2 page Brochure of EDG, Inc., Undated.

*Primary Examiner*—Dennis L. Taylor

*Attorney, Agent, or Firm*—Tobor & Goldstein, L.L.P.

[57] ABSTRACT

A support structure for use with at least two wells, and a method for providing and supporting at least two wells in the ground beneath a body of water, includes a caisson, a plurality of conductors, and a guide frame, which support at least two wells without the use of any piles or brace members, the at least two wells being supported solely by the conductors, the caisson, and the guide frame.

20 Claims, 18 Drawing Sheets

OFFSHORE SUPPORT STRUCTURE METHOD AND APPARATUS

BACKGROUND OF THE INVENTION

1. Field of the Invention

The invention relates to an offshore support structure for use with at least two wells and a method for providing and supporting at least two wells in the ground beneath a body of water, the wells each having an upstanding conductor extending from the ground below the body of water to above the surface of the water, with a caisson disposed between the upstanding conductors.

2. Description of the Prior Art

In the production of hydrocarbons from wells disposed in the ground beneath a body of water at an offshore location, it is common to drill the well in shallow water depths of approximately 50 to 200 feet, by first driving a well conductor pipe, or conductor, in a conventional manner, and then drilling the well through the conductor, in a conventional manner. Typically, a conventional, jackup drilling rig, or a semi-submersible drilling rig, may be utilized for drilling the well, and the vessel which supports the drilling rig typically remains on location during the drilling process. If it is determined that the formation surrounding the well contains desired hydrocarbons in a sufficient amount to justify production of hydrocarbons from that well, a jacket structure, or production platform, is fabricated for supporting the conductor and for supporting well production equipment, as is well known in the art. Conventional jacket structures associated with an offshore, upstanding conductor, generally require the driving of piles to secure the jacket structure to the ground beneath the body of water, whereby the well disposed within the upstanding conductor is protected from damage from ships navigating in the area adjacent the conductor, and from forces exerted by the body of water upon the conductor caused by severe weather conditions, such as winter storms and/or summer hurricanes. Conventional jacket structures typically extend from the ground beneath the body of water to above the surface of the water, and are designed for conforming to the particular water depth and soil conditions and elevations present at the site of the offshore well. Typically these jacket structures, in addition to the use of piles to support the jacket structure and the conductor, also include a plurality of inner-connected braces, or brace members. Such brace members generally include a plurality of legs which may be disposed perpendicular to the ground beneath the body of water, or "battered" legs, or legs disposed at an angle other than 90° with respect to the ground beneath the body of water. Once the piles have been driven to secure the jacket structure, other wells may be drilled at the site of the jacket structure if desired.

There are some disadvantages associated with the foregoing described methods and apparatus. For example, if additional wells are desired at the site of the first well, it is generally necessary for the drilling rig to return, after the fabrication and installation of the jacket structure, in order to drill any additional wells. In general, the drilling costs for the additional wells are increased because of the necessity for the drilling rig to return to the jacket structure to drill the additional well, or wells. To the extent that additional wells are contemplated at the same offshore location, the jacket structure must be originally designed and fabricated to accommodate the contemplated additional well, or wells, including the ability for the jacket structure to support the necessary production equipment for all the additional, contemplated wells. After the installation of the jacket structure, if one, or more, of the additional wells are not successful, for either technical or economical reasons, the installed jacket structure may be oversized and/or overdesigned, for the actual number of producing wells. Additionally, once the first conductor has been installed, and the first well has been drilled, the owner and/or operator of that well generally must commit to providing some type of support structure for that conductor, in order to protect it from damage from ships navigating in the area and from forces exerted upon the conductor by the body of water, resulting from severe weather conditions. This support structure generally requires the costly step of fabrication and installation of a conventional jacket structure for that well and conductor. In general, the conductor and associated well should be supported and protected as soon as possible; however, prior art structures and methods do not generally permit a less expensive and more efficient support structure to be utilized, which does not require the use of piles and/or various types of brace members, including jacket legs.

Accordingly, prior to the development of the present invention, there have been no offshore support structure methods and apparatus which: minimize drilling costs and drilling rig time; do not require the use of piles and brace members to support the conductor; permit the owner/operator to drill and test more than one well, so that a jacket structure can be optimally designed and fabricated, dependent upon the number of wells to be produced from the jacket structure; and gives the owner/operator the option to drill and test more than one well and then leave the two, or more, wells supported at the offshore location protected from damage, in an efficient and economical manner, until the owner/operator determines that the fabrication and installation of the jacket structure is warranted.

Therefore, the art has sought an offshore support structure method and apparatus for use with at least two offshore wells which: minimizes drilling rig costs and time requirements; does not require the use of conventional piles and/or brace members to support two or more wells; permits the owner/operator to drill and test two or more wells before designing and fabricating a jacket structure for the wells, whereby the jacket structure may be optimally designed and fabricated, at an optimum, minimum cost; and permits the owner/operator the option to support the two or more wells in an efficient and economical manner, until the owner/operator determines that the fabrication and installation of a jacket structure is warranted for placing the two, or more, wells in production.

SUMMARY OF THE INVENTION

In accordance with the invention, the foregoing advantages have been achieved through the present method for providing and supporting at least two wells in the ground beneath the body of water. This aspect of the present invention includes the steps of: installing a first conductor, having an upper and a lower end, in the ground, with the first conductor extending from below the ground to above the body of water; drilling a first well through the first conductor to provide the first well; installing a subsea template on the ground adjacent the lower end of the first conductor; installing a caisson, having an upper and a lower end, in the ground, the caisson extending from below the ground, through the subsea template, to above the body of water; attaching a guide frame to the caisson and the first conductor, proximate the upper ends of the caisson and the first conductor, the guide frame including at least one conductor guide; installing a second conductor, having an upper end and a lower end, in the ground, by passing the second conductor through the at least one conductor guide and the subsea template, with the second conductor extending from below the ground to above the body of water; drilling a second well through the second conductor to provide the second well; and maintaining the at least two wells in the body of water for a period of time, with the at least two wells being supported without any piles or brace members, and being supported solely by the first and second conductors, the caisson, and the guide frame.

Another feature of this aspect of the present invention may include the step of releasably attaching a boat landing to the caisson. An additional feature of this aspect of the present invention is that the boat landing may be releasably attached to the caisson by utilizing a releasable connection means associated with the guide frame and the boat landing. A navigation aids deck may be releasably attached to the caisson.

A further feature of this aspect of the present invention may include the step of drilling a third well through the caisson. Another feature of this aspect of the present invention is that the subsea template may be installed by disposing the subsea template about the upper end of the first conductor and lowering the subsea template until it lies upon the ground adjacent the first conductor.

An additional feature of this aspect of the present invention may include the steps of: providing the subsea template with a plurality of conductor guide members; providing the guide frame with a plurality of conductor guides; installing an additional number of conductors, having upper and lower ends, extending from below the ground to above the body of water, each of the additional conductors being installed by passing the lower end of each conductor first through a conductor guide of the guide frame and then through a conductor guide member of the subsea template; and drilling an additional number of wells through the additional conductors to provide additional wells. Another feature of this aspect of the present invention may include the steps of: after the passage of the period of time, installing a jacket structure adjacent to the first and second conductors and caisson; and fixedly securing the jacket structure to the caisson. At least one production deck may be installed to the jacket structure.

The present invention also includes a support structure for use with at least two wells in the ground beneath a body of water. This aspect of the present invention includes: at least two conductors, each conductor having a diameter, an upper end, and a lower end, each conductor adapted to extend from below the ground to above the body of water, and the at least two wells are adapted to be disposed within the at least two conductors; a caisson, having a diameter, an upper end and a lower end, and adapted to extend from below the ground to above the body of water, the caisson being disposed between, and in a spaced relationship with, the at least two conductors, the at least two conductors and caisson being disposed substantially perpendicular to the ground; a subsea template disposed on the ground proximate the lower ends of the caisson and the at least two conductors, the subsea template adapted to be disposed on the ground without being secured to the ground with one or more piles and includes a conductor guide member for each of the at least two conductors, and a caisson guide member for the caisson, with at least two conductors being disposed within the conductor guide members proximate the lower ends of the at least two conductors, and the caisson being disposed within the caisson guide member proximate the lower end of the caisson; a guide frame fixedly secured to the caisson and disposed proximate the upper ends of the caisson and the at least two conductors, the guide frame including a conductor guide for each of the at least two conductors, the at least two conductors being disposed within the conductor guide proximate the upper ends of the at least two conductors; and the caisson and the at least two conductors not including any piles or brace members, whereby the at least two wells are adapted to be supported in the body of water solely by the caisson, the at least two conductors, and the guide frame.

An additional feature of this aspect of the present invention is that a boat landing is attached to the caisson, and the guide frame and the boat landing may include a means for releasably attaching the boat landing to the caisson. Another feature of this aspect of the present invention is that a navigation aids deck may be attached to the caisson, and the navigation aids deck may include a means for releasably attaching the navigation aids deck to the caisson. An additional feature of this aspect of the present invention is that at least one of the conductor guide members may include a means for clamping the at least one conductor guide member to one of the conductors. A further feature of this aspect of the present invention is that the at least two conductors and the caisson each have a longitudinal axis, and the longitudinal axes of the at least two conductors and the caisson are substantially coplanar. Another feature of this aspect of the present invention is that the diameter of the caisson is larger than the diameter of each of the at least two conductors.

The offshore support structure method and apparatus, for use with at least two wells, of the present invention, when compared with previously proposed prior art offshore support structure methods and apparatus, have the advantages of: being simple and economical to manufacture and use; minimize drill rig time and cost factors; not requiring the use of conventional piles or brace members, including jacket legs; permits the drilling and testing of two or more wells so that the test results can be used in designing an optimal, minimum cost jacket structure for the wells; and giving the owner/operator of the wells the option to install a less expensive support structure for the wells, until the owner/operator determines that the installation and fabrication of a jacket structure is warranted for the wells.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
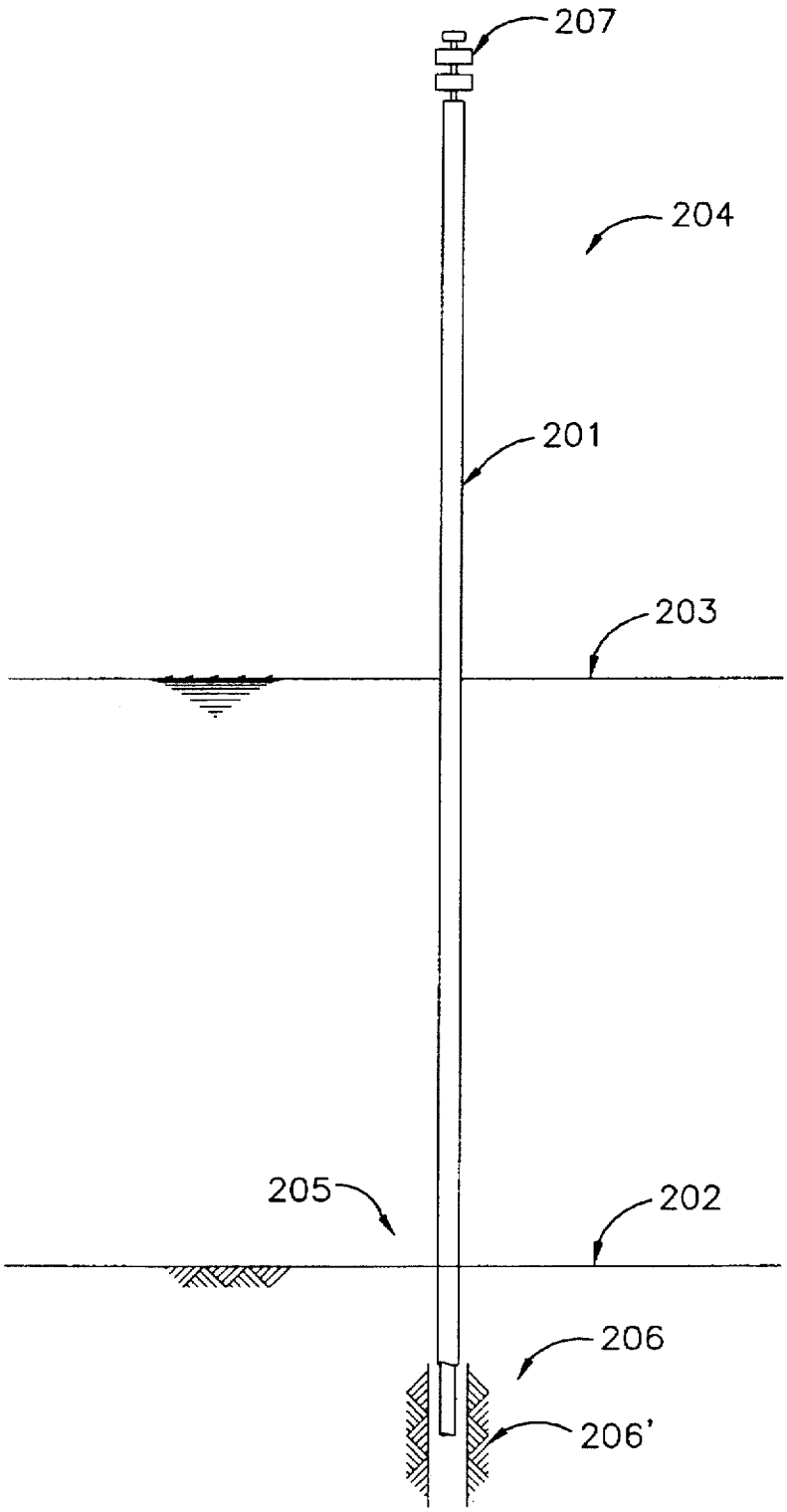
FIG. 1 is a front view of a conductor, with a well disposed therein, disposed in the ground beneath a body of water.
Figure 2:
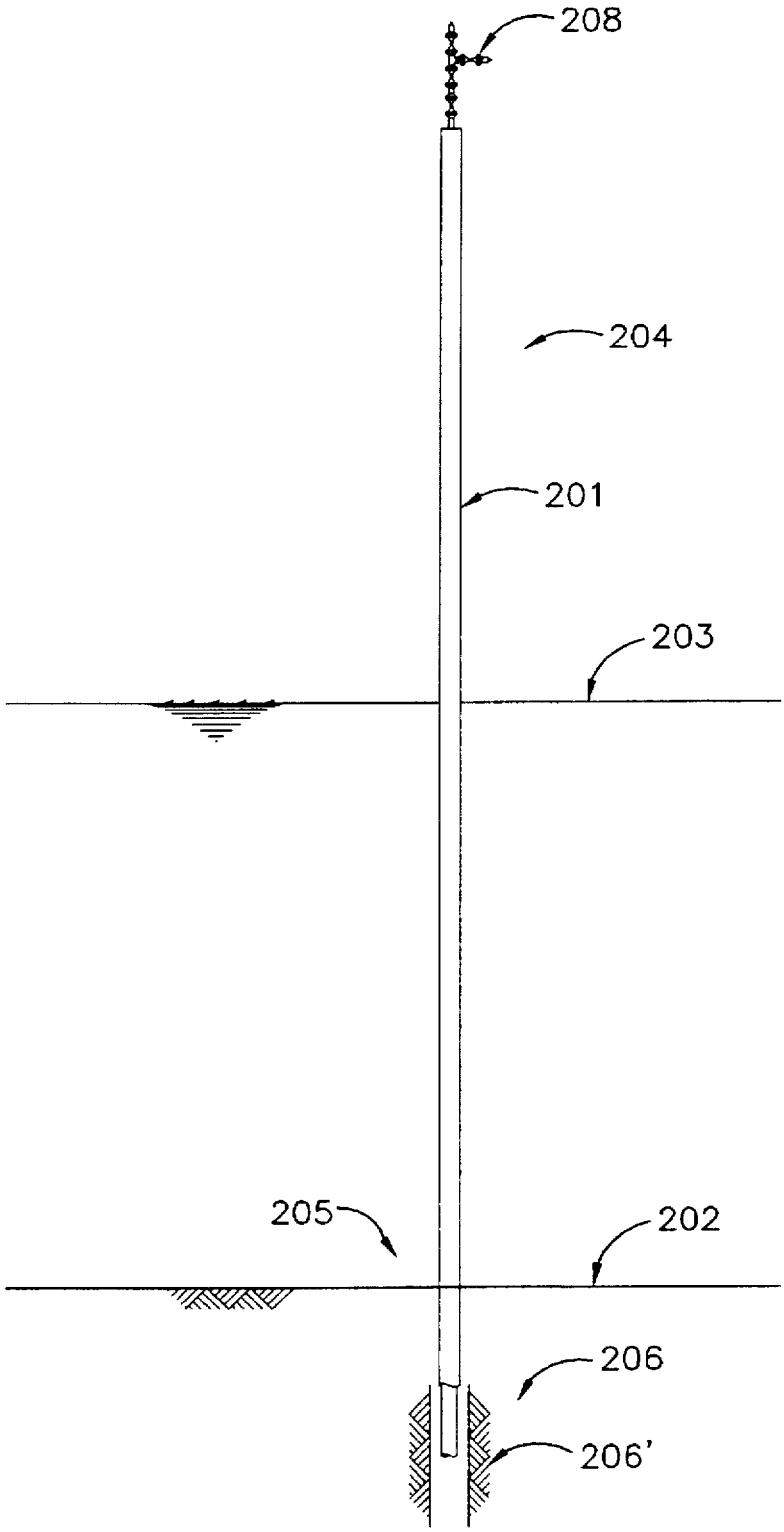
FIG. 2 is a front view of the conductor of FIG. 1, with a Christmas tree attached to the well.

With reference to FIGS. 1–6, the method for providing and supporting at least two wells in the ground beneath a body of water, in accordance with the present invention, with the support structure 200 (FIGS. 5 and 6) in accordance with the present invention will be described. With reference to FIG. 1, a first conductor, or conductor pipe, 201 is illustrated after having been installed in the ground 202 beneath a body of water, such as at an offshore location. Preferably, the support structure 200 of the present invention is used in water depths of from 25 to 200 feet of water, which are considered to be shallow water, offshore locations. First conductor 201 is of conventional tubular construction, and formed of a suitable material for use as an offshore conductor, or conductor pipe, such as steel. First conductor has an upper end 204 and a lower end 205, with the lower end 205 of first conductor being disposed within the ground 202, some predetermined distance, and extends from the ground 202 to a location above the body of water 203. First conductor 201 may be installed in ground 202 in a conventional manner, as by use of a conventional hydraulic hammer (not shown) disposed upon a work barge (not shown), or on a jackup drilling rig or a semisubmersible drilling rig, or some other type of conventional drilling rig (not shown). After the first conductor 201 has been installed, as shown in FIG. 1, a first well 206 is drilled through the first conductor 201 in a conventional manner to provide the first well 206. The first well 206 may be drilled by use of conventional equipment on the drilling rig (not shown). In a conventional manner, the well 206 may be shut in through use of a conventional blowout preventor stack 207. In a conventional manner, the well may be logged, or tested, to determine if hydrocarbons are present in the formation 206' surrounding well 206, as is known in the art.

If the log of the first well 206 is successful, and it is determined that it would be desirable to produce hydrocarbons from well 206 at a future time, conventional production casing and/or production tubing may be run into well 206, and the production casing and/or tubing, is closed by the installation of a conventional Christmas tree 208, which is substituted for the blowout preventer stack 207. If the log of well 206 were not successful, the well 206 would be abandoned in a conventional manner.

Figure 3:
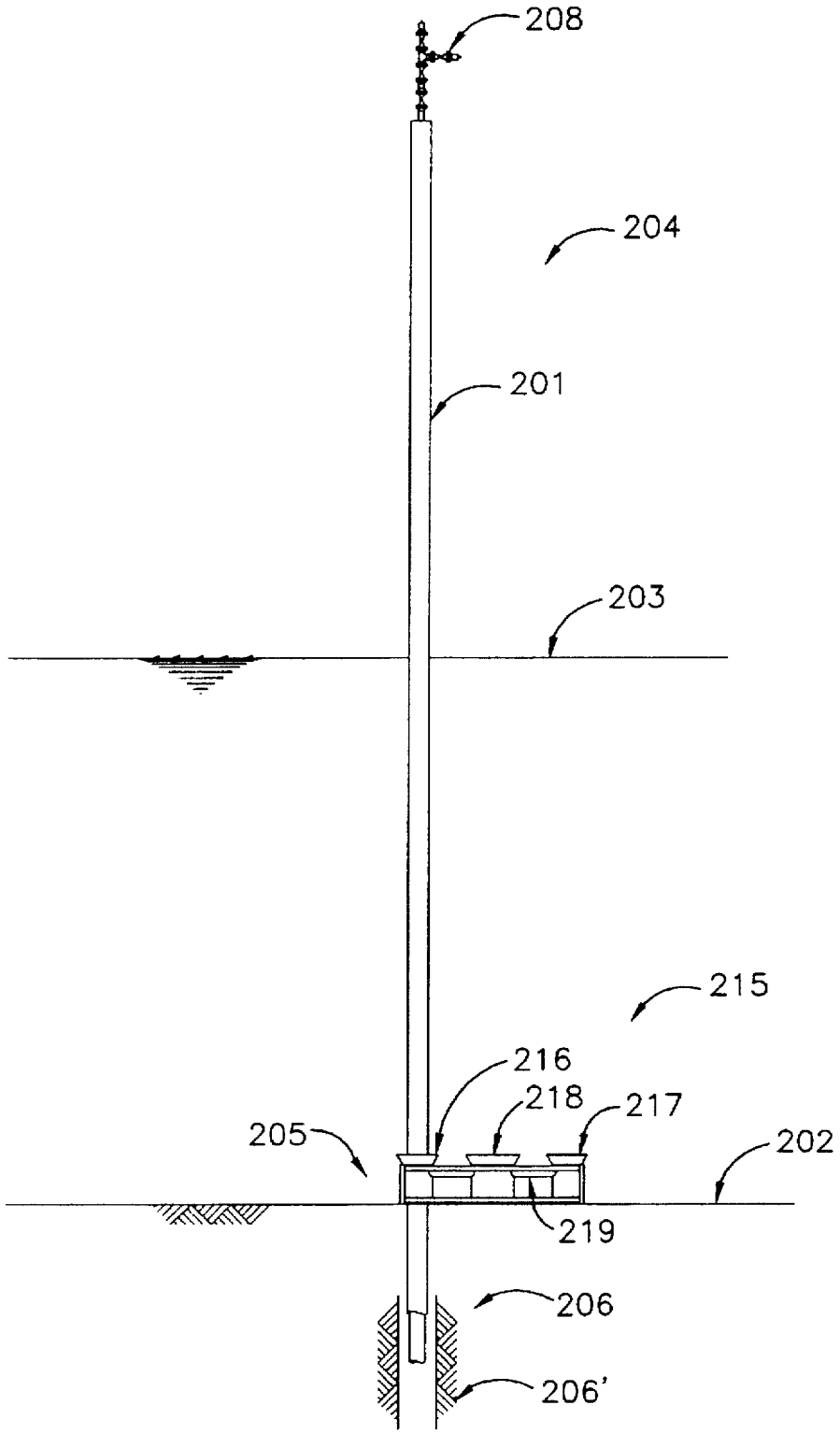
FIG. 3 is a front view of the conductor of FIG. 2, with a subsea template, in accordance with the present invention, disposed on the ground.
Figure 15:
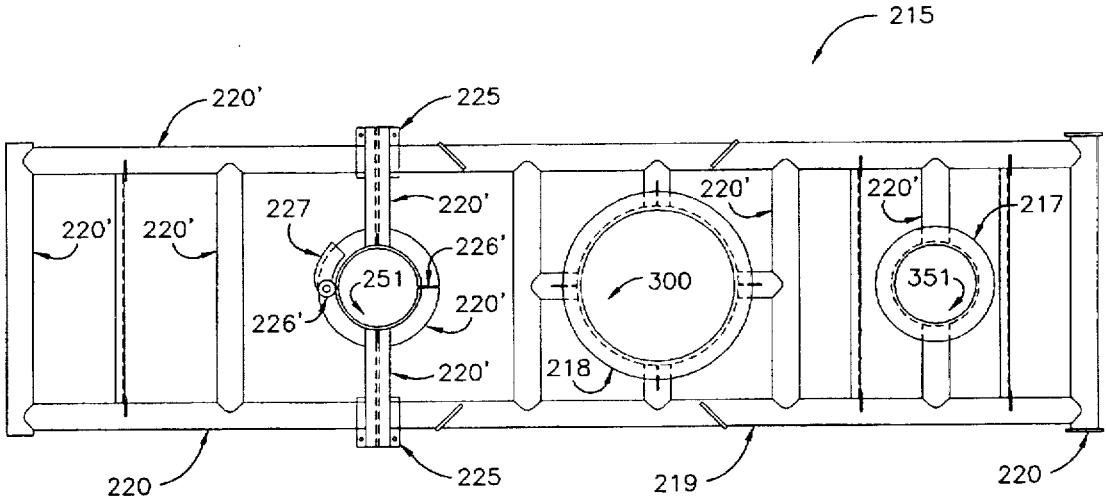
FIG. 15 is a top view of the subsea template illustrated in FIG. 3.

After the first well 206 has been drilled, and Christmas tree 208 installed, as seen in FIG. 3, a subsea template 215 is installed on the ground 202 adjacent the lower end 205 of the first conductor 201 proximate ground 202. Preferably, the subsea template 215 is installed by disposing the subsea template about the upper end 204 of the first conductor 201, and the subsea template is lowered until it lies upon the ground 202 adjacent the first conductor 201, as shown in FIG. 3. With reference to FIGS. 3 and 15, subsea template 215 preferably includes a first conductor guide member 216, a second conductor guide member 217, and a caisson guide member 218 supported by a framework 219. Framework 219 is preferably formed of a plurality of tubular members 220, or other rolled or fabricated steel members, which are welded to each other, or in some other conventional manner fixedly secured to each other, whereby framework 219 serves to support conductor guide members 216, 217, and caisson guide member 218 in a fixed, spaced relationship. Subsea template 215 may be provided with conventional mudmats (not shown), which permit the passage of first conductor through first conductor guide 216, and the passage of the caisson and second conductor to pass through caisson guide member 218 and second conductor guide member 217, as will be hereinafter described. Framework 219 is of a generally rectangular configuration, as seen in FIG. 15; however, it will be readily apparent to one of ordinary skill in the art that framework 219 could have any desired configuration. Although the first conductor guide member 216 could be fixedly secured within framework 219, it is preferred that first conductor guide member 216 is releasably attached to framework 219 as by any suitable, conventional connection means 225, whereby first conductor guide member 216 and its associate tubular members 220' may be removed from framework 219. Preferably, first conductor guide member 216 is of a split construction as shown at 226, and includes a conventional hinged clamp 227, which permits first conductor guide member 216 to be opened and disposed about the upper end 204 of first conductor 201 and then closed, and clamped, about the first conductor through operation of the hinged clamp 227. Of course, other association devices could be used for associating, or attaching, the first conductor guide member to the first conductor.

Thus, with reference to FIGS. 3 and 15, the first conductor guide member 216 may be removed from subsea template 215, and subsea template 215 may be stabbed over the upper end 204 of first conductor 201, while it is being supported by a crane, or other suitable device, (not shown) located upon the drilling rig (not shown). The first conductor guide member 216 may then be opened, by operation of hinged clamp 227, and disposed about the first conductor 201, whereby the first conductor guide member 216 surrounds the first conductor 201. The first conductor guide member 216 may then be secured to framework 219, as by bolting it to framework 219, via the connection means 225 on tubular members 220'. Alternatively, one of the connection means 225 could be a hinged connection, whereby first conductor guide member 216 and its associated tubular members 220' could be hingedly, or pivotably, mounted to framework 219. It should be noted that the diameter d of first conductor guide member 216, while closely conforming to the diameter D of the first conductor 201, the diameter d of the first conductor guide member 216, is slightly larger than the diameter D of the first conductor 201. Accordingly, relative motion is permitted between the first conductor guide member 216 and the first conductor 201, whereby the subsea template 215 may be lowered by a crane, (not shown) on the drilling rig (not shown), until the subsea template 215 is disposed in the position illustrated in FIG. 3 on ground 202 adjacent first conductor 201.

Subsea template 215 is oriented with respect to first conductor 201, so that it is disposed adjacent first conductor 201 in its desired location as illustrated in FIG. 3, by use of any conventional orientation means, such as a gyroscope, or other similar equipment, so that the location and orientation of subsea template 215 with respect to the first conductor 201 is known.

Figure 4:
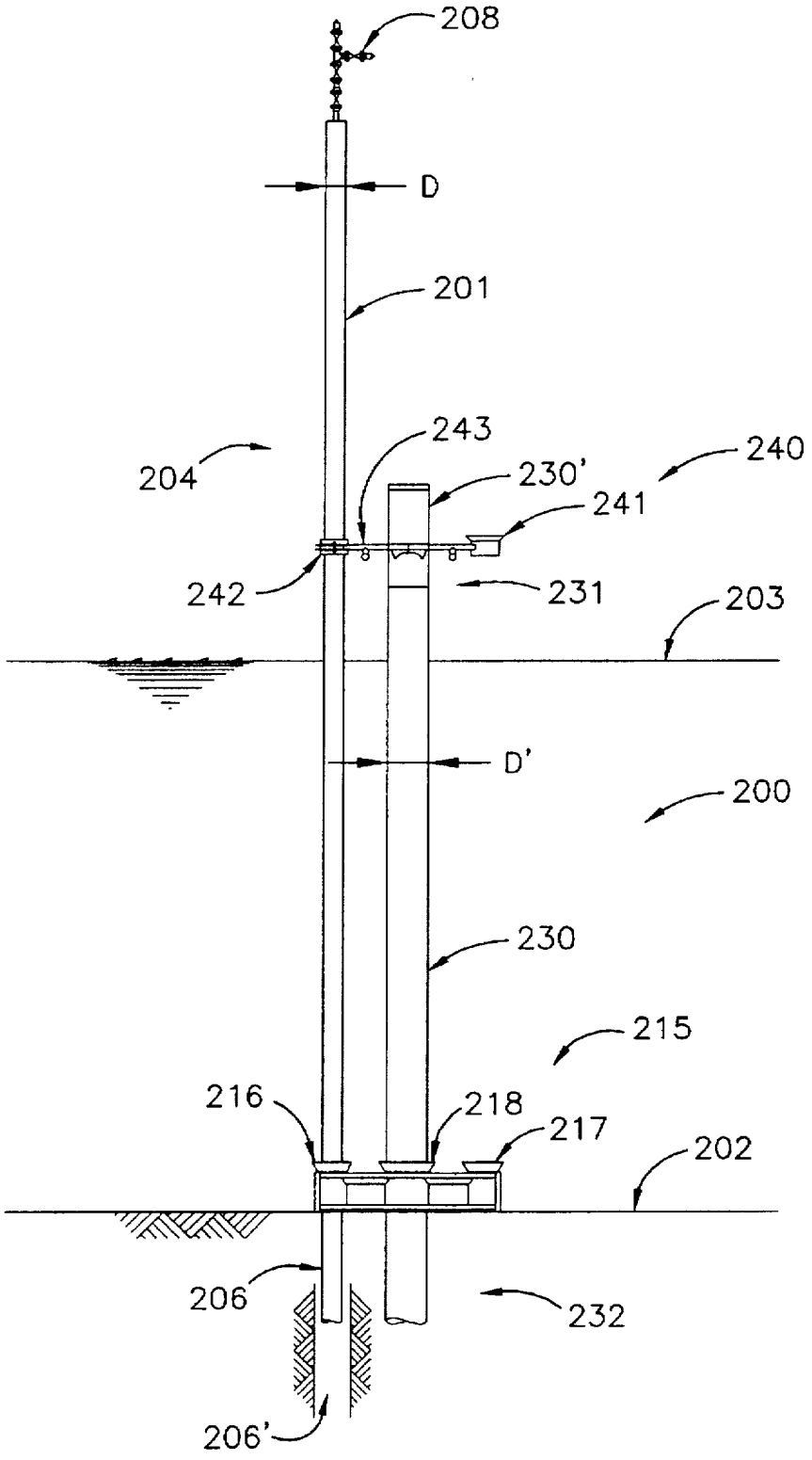
FIG. 4 is a front view of the apparatus of FIG. 3, with a caisson and guide frame installed, in accordance with the present invention.
Figure 5:
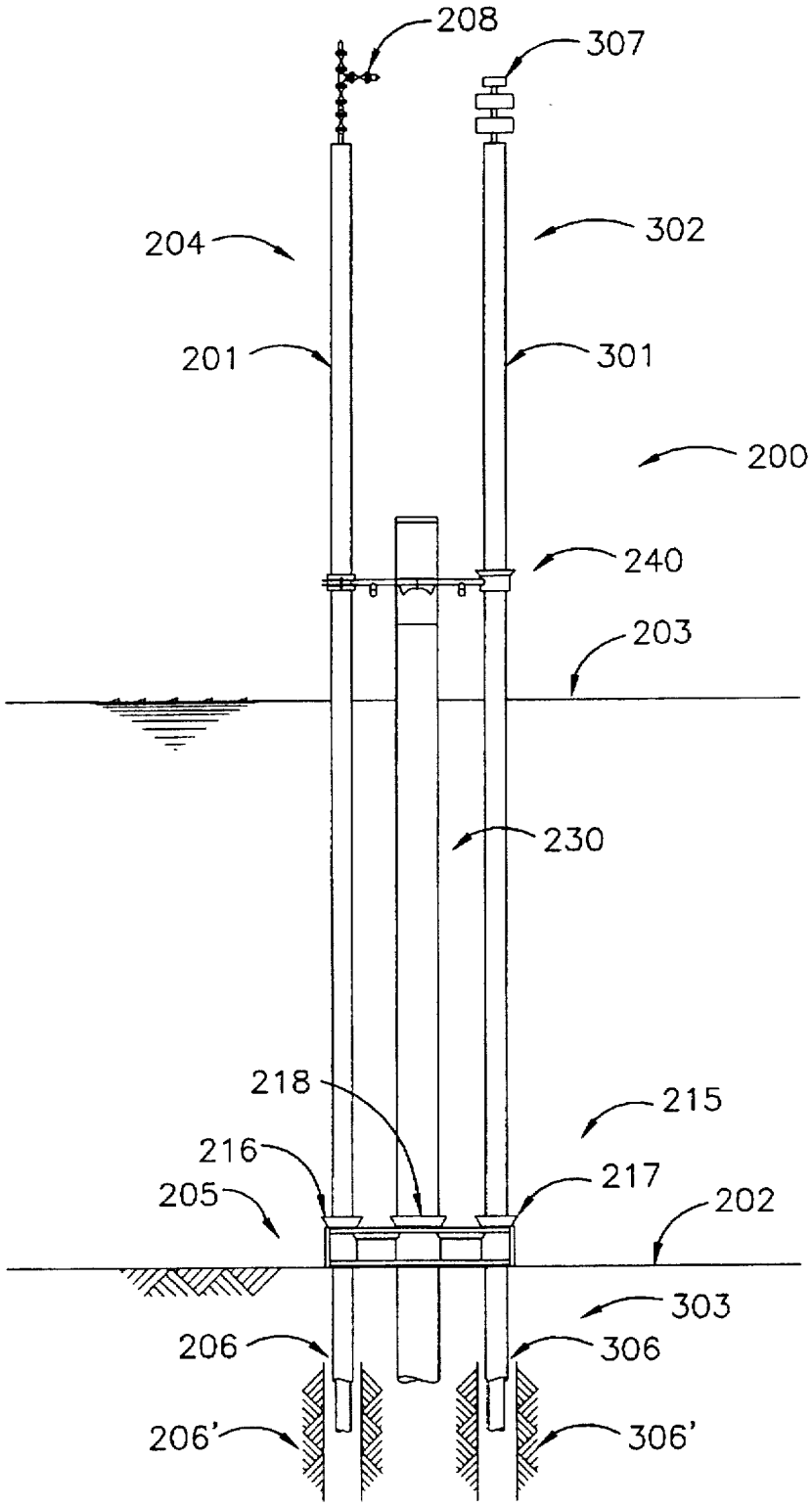
FIG. 5 is a front view of the apparatus of FIG. 4, with a second conductor installed.

With reference to FIG. 4, after subsea template 215 has been installed, a caisson 230, having an upper end 231 and a lower end 232, is installed into the ground 202, with caisson 230 extending from the ground 202, through the subsea template 215, to a location above the body of water 203. Caisson 230 is preferably of tubular construction, and is also manufactured of a suitable steel material, or any other material having the requisite strength characteristic necessary for use in an offshore support structure 200. Caisson 230 may be installed through use of conventional equipment, such as a hydraulic hammer (not shown) located on the drilling rig (not shown), or a conventional work barge (not shown), as is known in the art. Caisson 230, if desired, may be of a segmental construction, whereby sections of the caisson 230 may be driven into the ground 202 with subsequent sections of caisson 230 being welded to the previously installed sections of caisson 230, as is well known in the art. By use of the term "caisson" is meant that the diameter D' of the caisson is larger than the diameter D of the first conductor 201, whereby caisson 230 serves to provide sufficient rigidity and support for support structure 200. Support structure 200 then may withstand the forces exerted by the body of water 203 upon first conductor 201 and second conductor 301 (FIG. 5). By way of example, for illustration purposes only, for a support structure 200 disposed in 50–60 feet of water, caisson 230 could have a diameter D' of 48 inches and the diameter D of the conductors 201, 301 could be 24 inches. As seen in FIG. 4, the lower end 232 of caisson 230 is passed through caisson guide member 218 of subsea template 215 some predetermined distance into ground 202. Preferably, the lower end 232 of caisson 230 is stabbed through caisson guide member 218, in a conventional manner, and then is driven into ground 202, in a conventional manner.

Figure 13:
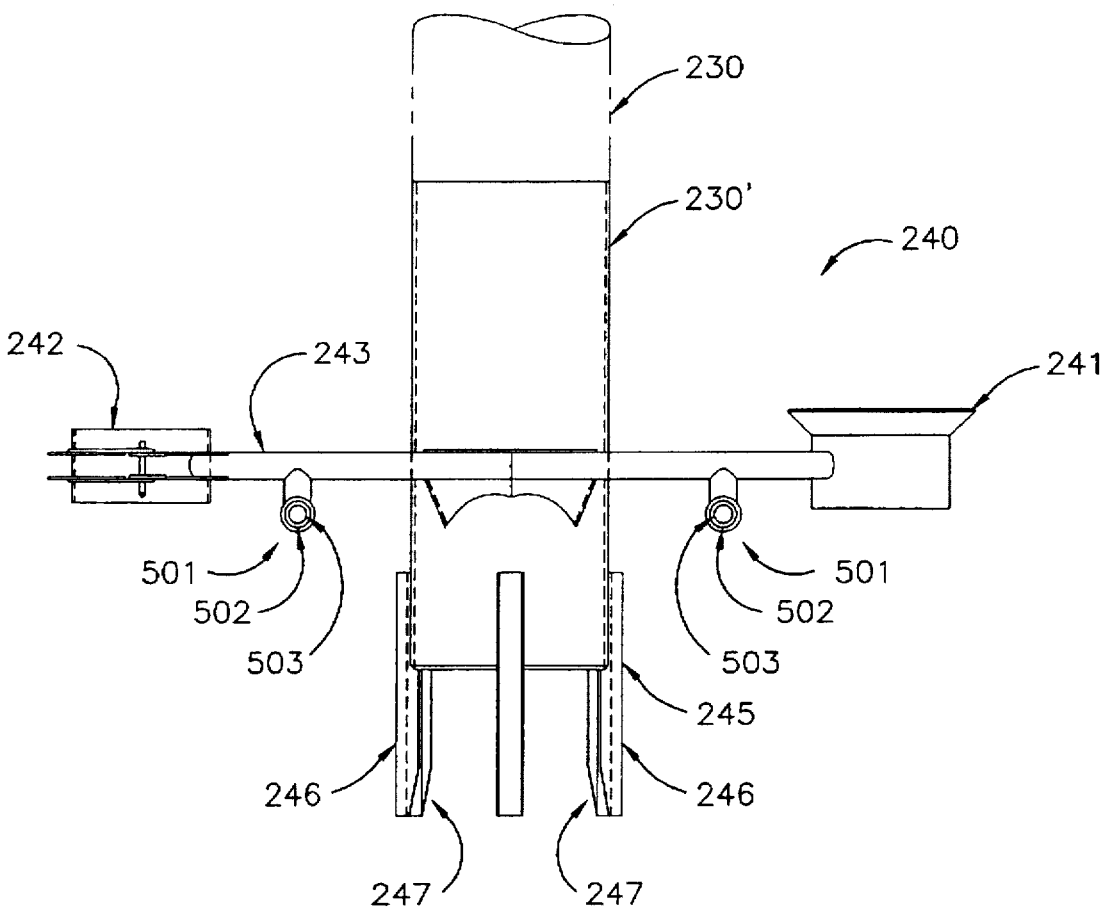
FIG. 13 is a from view of one embodiment of a guide frame in accordance with the present invention.
Figure 14:
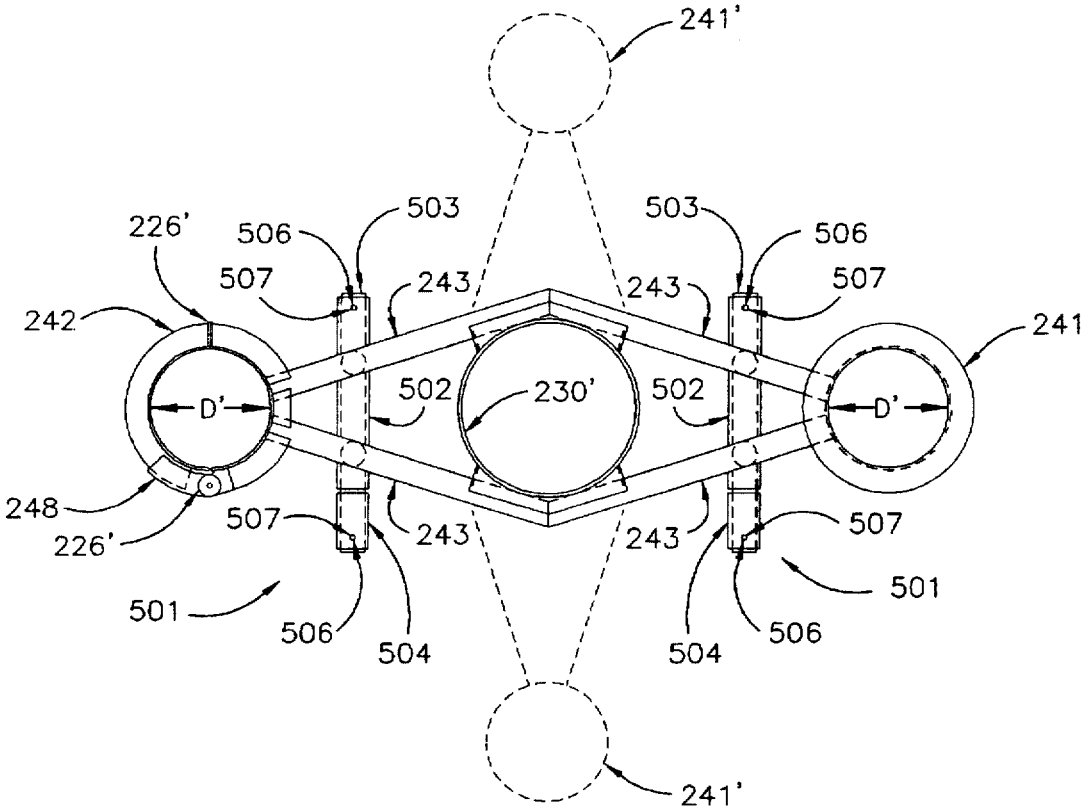
FIG. 14 is a top view of the guide frame of FIG. 13.

After caisson 230 has been installed, a guide frame 240 is attached to the caisson 230 and first conductor 201. Guide frame 240 has at least one conductor guide 241, and preferably has a second conductor guide 242. With reference to FIGS. 13 and 14, guide frame 240 includes a plurality of tubular frame members 243, or other rolled or fabricated steel members, to which conductor guides 241,242 are rigidly attached, as by welding in a conventional manner. Guide frame 240 is preferably attached to caisson 230 by welding tubular frame members 243 to a caisson segment 230', the lower end 245 of caisson segment 230' being provided with a plurality of outwardly disposed guide members 246, having a tapered guide surface 247. Guide frame 240 is preferably lowered, as by a crane, or other mechanical means, (not shown) on the drill rig (not shown) and lowered upon caisson 230 until the lower end 245 of caisson segment 230' mates and abuts with the upper end 231 of caisson 230. Caisson segment 230' may then be fixedly secured to caisson 230 as by welding, or by some other conventional attachment means, such as bolts, etc. It should be noted that the orientation of the conductor guides 241,242 with respect to caisson 230 should correspond to the orientation of the conductor guide member 217, 216 of subsea template with respect to caisson 230. If desired, guides 246 may be removed from caisson segment 230', after caisson segment 230' has been welded to caisson 230. Alternatively, guide frame 240 could be merely stabbed over the upper end 231 of caisson 230 and the frame members 243 could then be welded to caisson 230. As seen in FIGS. 13 and 14, conductor guide 241 is of similar construction to conductor guide member 217 of subsea template 215 (FIG. 15). Similarly, the conductor guide 242 is of similar construction to that of conductor guide member 216 of subsea template 215 (FIG. 15), in that it is also of a split construction, as shown at 226' and includes a hinged clamp connection 248, similar to that of hinge clamp connection 227 for conductor guide member 216 of subsea template 250. Thus, prior to attaching guide frame 240 to caisson 230, the conductor guide 242 is opened so that the conductor guide 242 may be placed around the upper end 204 of first conductor 201, and then closed and clamped about first conductor 201. Alternatively, a conventional doubler plate, such as a slightly curved doubler plate, could be substituted for conductor guide 242. The curved doubler plate (not shown) could be disposed in an abutting relationship with the first conductor 201 as guide frame 240 is attached to caisson 230, and the curved doubler plate could then be welded to the first conductor 201. Although the diameter d' of conductor guide 242 could be the same size as diameter D of conductor 201, it is preferred that the diameter d' of conductor guide 242 be slightly larger than the diameter D of first conductor 201. Similarly, the diameter d' of conductor guide 241 is slightly larger than the diameter D of second conductor 301.

With reference to FIG. 5, after guide frame 240 has been attached to caisson 230, a second conductor 301, having an upper end 302 and a lower end 303 is installed into the ground 202, by passing, or stabbing, the lower end 303 of the second conductor 301 through conductor guide 241 and the subsea template 215, with the second conductor 301 extending from below the ground 202 to above the body of water 203. Preferably, the lower end 303 of the second conductor 301 is also stabbed through the conductor guide member 217 of subsea template 215, as shown in FIG. 5. Again, the second conductor 301 may be installed in a conventional manner, by use of a hydraulic hammer disposed on the drill rig, as previously described. A second well 306 may then be drilled through the second conductor 301 and the formation 306' adjacent the second well 306 may be logged in a conventional manner, as previously described. The second well 306 may then be capped with a blowout preventer stack 307, as previously described in connection with the first conductor 201.

Figure 6:
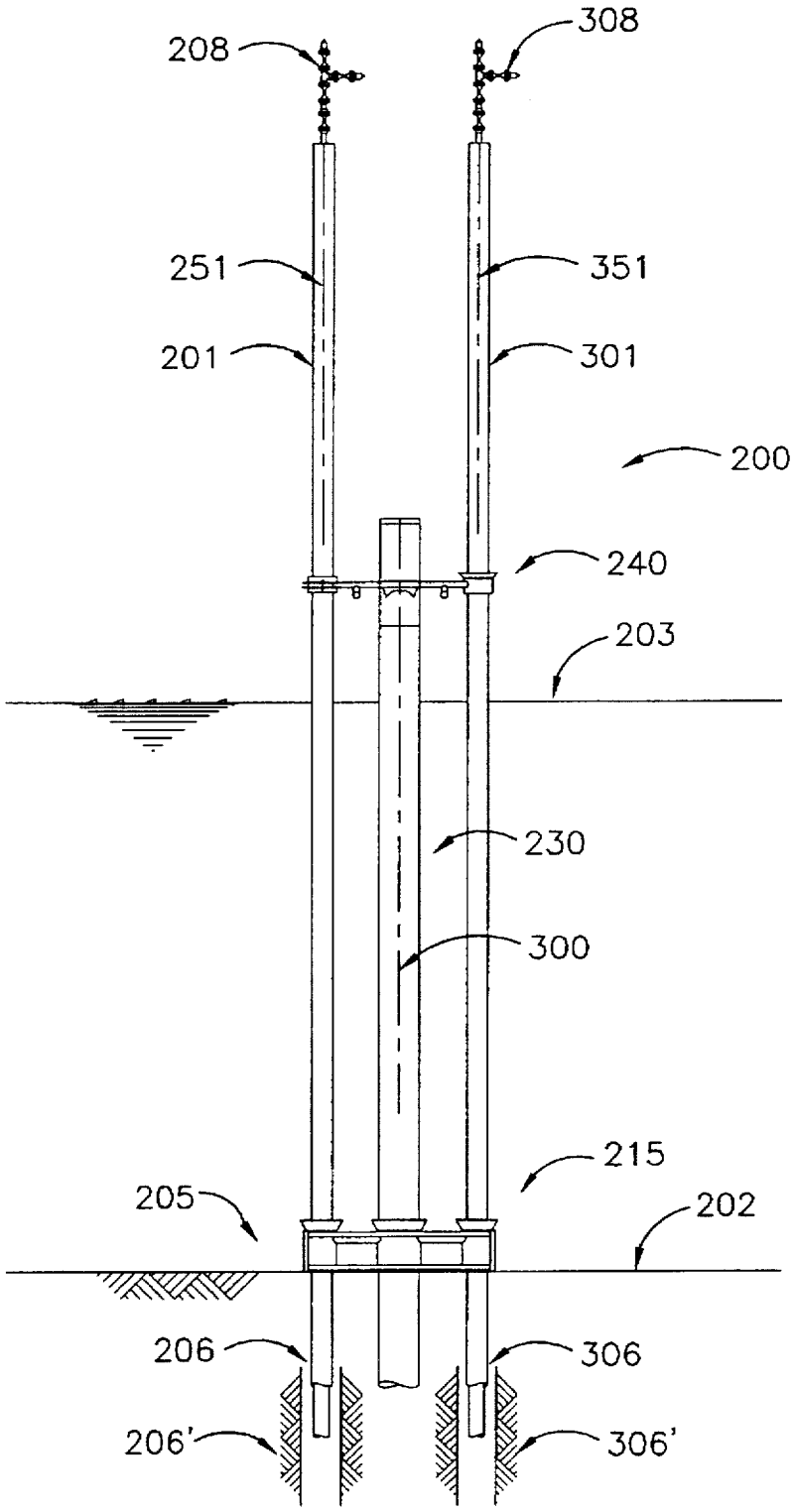
FIG. 6 is a front view of the support structure in accordance with the present invention, with a Christmas tree installed on the second well.

With reference to FIG. 6, if the log is successful, a Christmas tree 308 may be installed on the second well 306, after the production casing/tubing has been installed in a conventional manner. A support structure 200 for wells 206 and 306, is thus comprised of caisson 230, first conductor 201, second conductor 301, and guide frame 240, and the wells 206, 306, may be supported for any desired period of time in the body of water 203 without the use of any piles or brace members, including jacket structure legs. The wells 206, 306 are supported solely by the first and second conductors 201,301, the caisson 230, and the guide flame 240, until the owner/operator of the wells determines that placing the wells in production is warranted. The longitudinal axes 251, 351, and 300 of the first and second conductors 201,301 and caisson 230 are disposed substantially parallel to each other and are substantially coplanar with each other as shown in FIGS. 6 and 15. As illustrated in FIG. 6, the subsea template 215 may remain in place;

however, it does not provide any support to the wells, and in this regard, if desired, subsea template 215 could have been removed from the ground 202, after the second conductor 301 had been installed.

Figure 7:
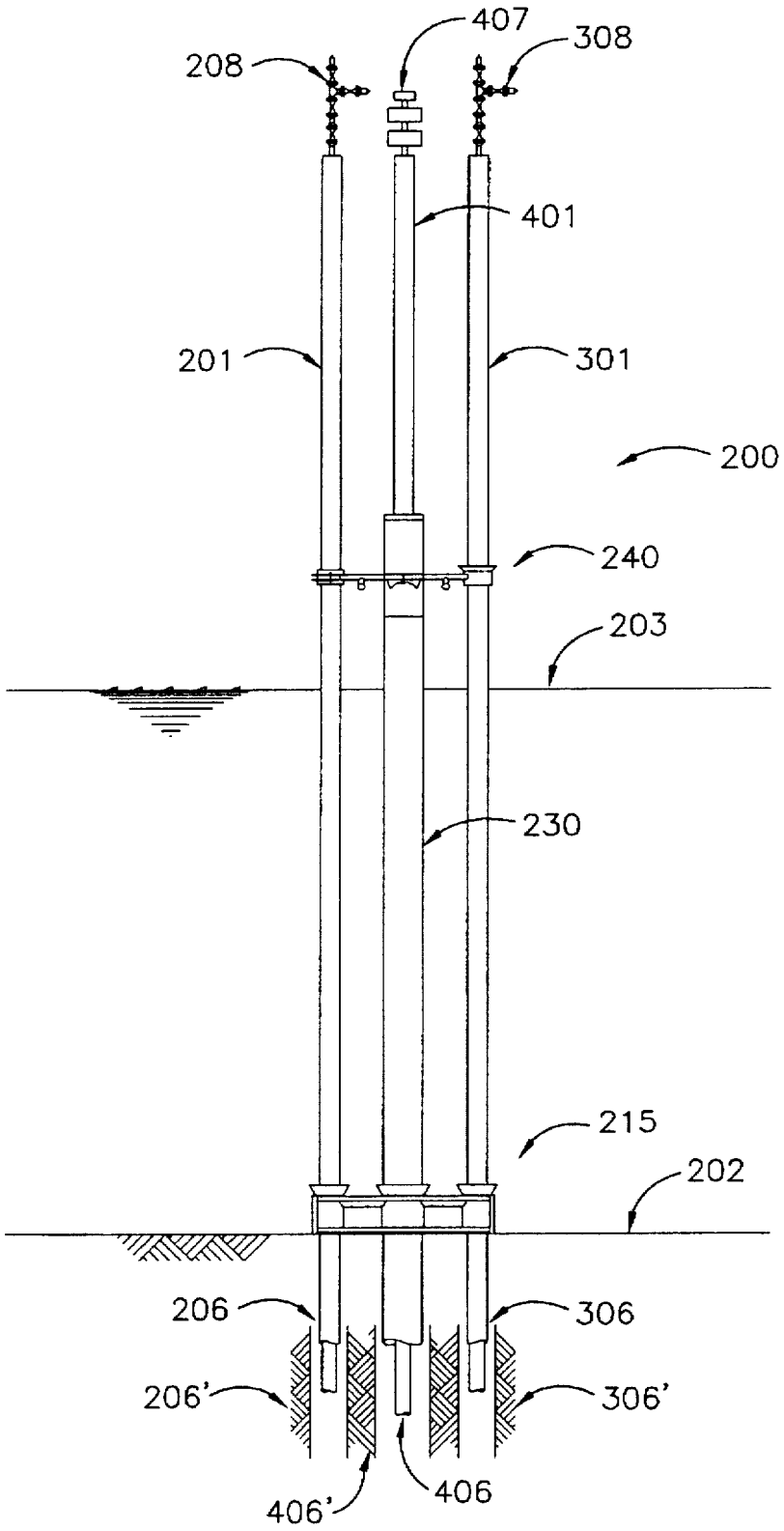
FIG. 7 is a front view of the support structure of FIG. 6, with a third well provided in the caisson.
Figure 8:
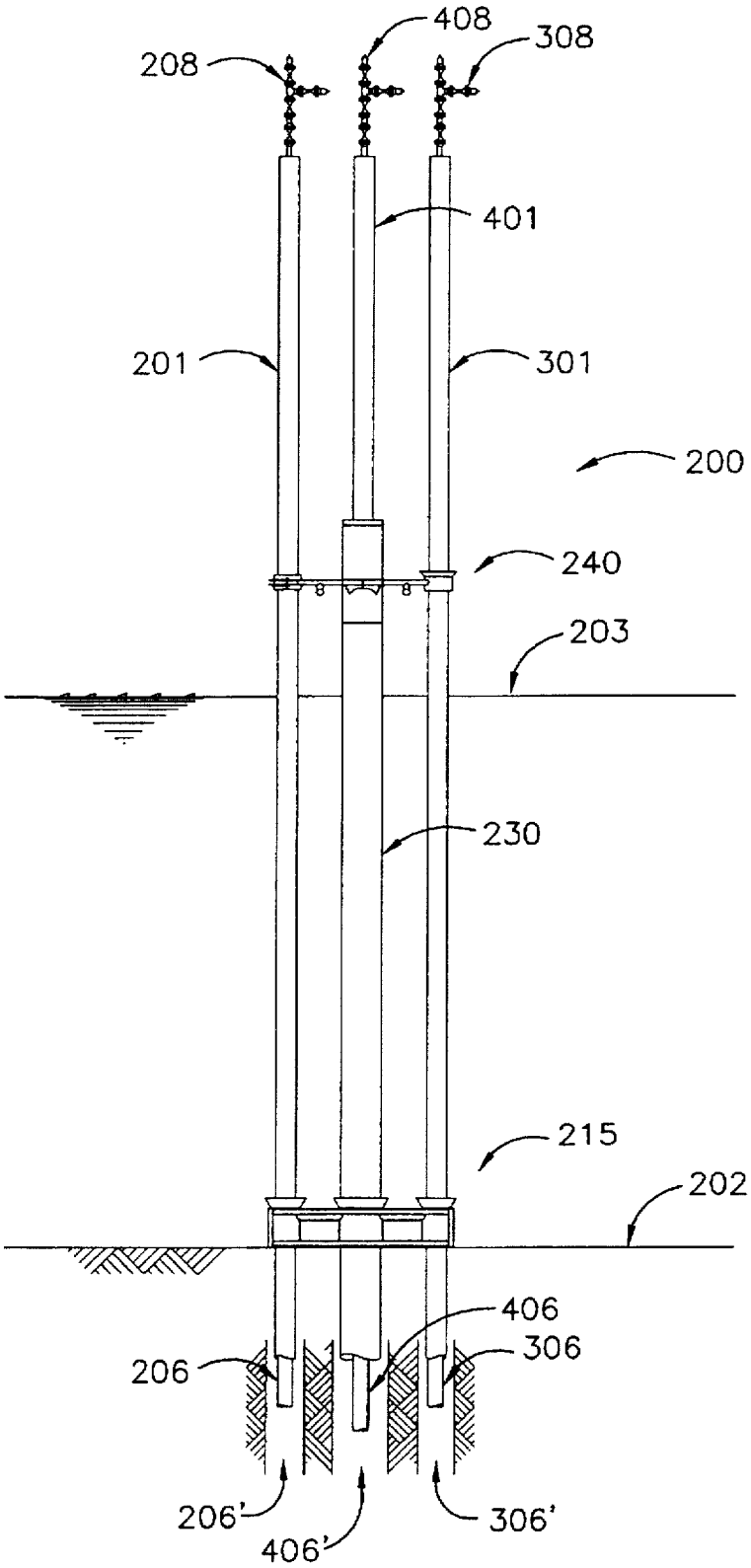
FIG. 8 is a front view of the support structure of FIG. 7, with a Christmas tree installed on the third well.

With reference to FIG. 7, a third conductor 401, if desired, could be installed through caisson 230, and a third well 406 could be drilled through the third conductor 401 in the same manner previously described in connection with the first and second wells 206, 306. Similarly, a blowout preventer stack 407 would be installed in connection with the third well 406. With reference to FIG. 8, a Christmas tree 408 could be installed on the third well 406, in the same manner previously described in connection with the first and second wells 206, 306.

Figure 9:
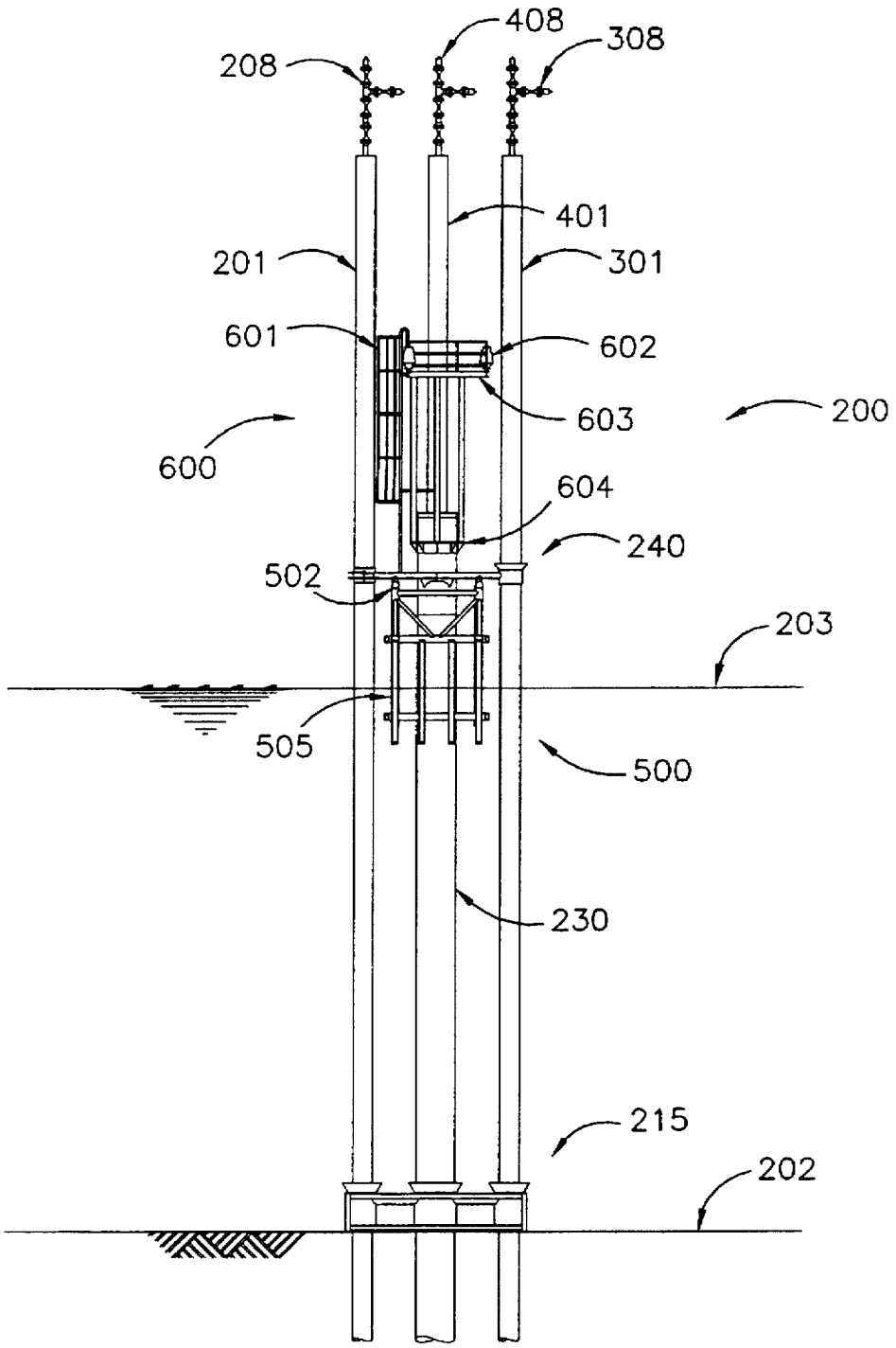
FIG. 9 is a front view of the support structure of FIG. 8, including a navigation aids deck and boat landing installed, in accordance with the present invention.
Figure 10:
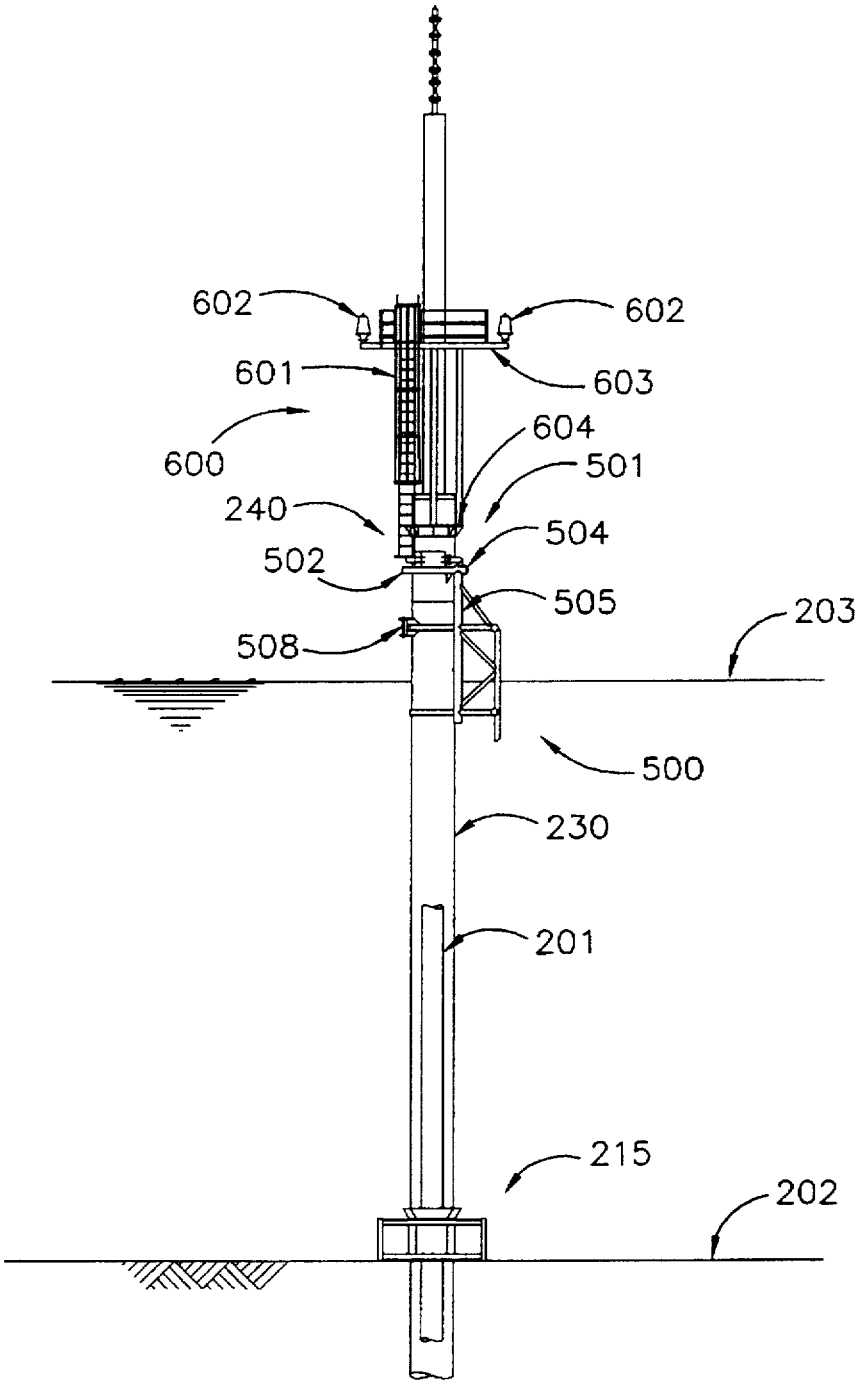
FIG. 10 is a side view of the support structure of FIG. 9.

With reference to FIGS. 9 and 10, a boat landing 500 may be attached to the caisson 230. Preferably, the boat landing 500 is releasably attached to the caisson by utilizing a releasable connection means 501 associated with the guide flame 240 and the boat landing 500. A navigation aids deck 600 may also be releasably attached to the caisson 230. With reference to FIGS. 13 and 14, guide frame 240 includes the means for releasably attaching 501 the boat landing 500 to caisson 230. Preferably attachment means 501 includes two tubular members 502 fixedly secured to guide frame 240 as by welding tubular members 502 to the frame members 243. A connection pin 503 may be passed through each of the tubular members 502, and tubular members 504 attached to downwardly extending support members 505 of boat landing 500 (FIGS. 9 and 10) may be passed over the connection pins 503. Thereafter, pins 506 may be passed through mating openings 507 in tubular members 502 and connection pins 503, thus releasably securing tubular members 504 of support legs 505 of boat landing 500 to the guide frame 240 associated with caisson 230. A clamp 508 may also be provided for releasably securing boat landing 500 to caisson 230.

With reference to FIGS. 9 and 10, the navigation aids deck 600 may include a caged ladder 601 and a plurality of navigation lights 602 disposed upon deck 603. A conventional solar panel (not shown) may be provided on deck 603 to provide power for navigation lights 602. Navigation aids deck 600 may be releasably clamped to caisson 230 by a conventional clamp 604.

Figure 11:
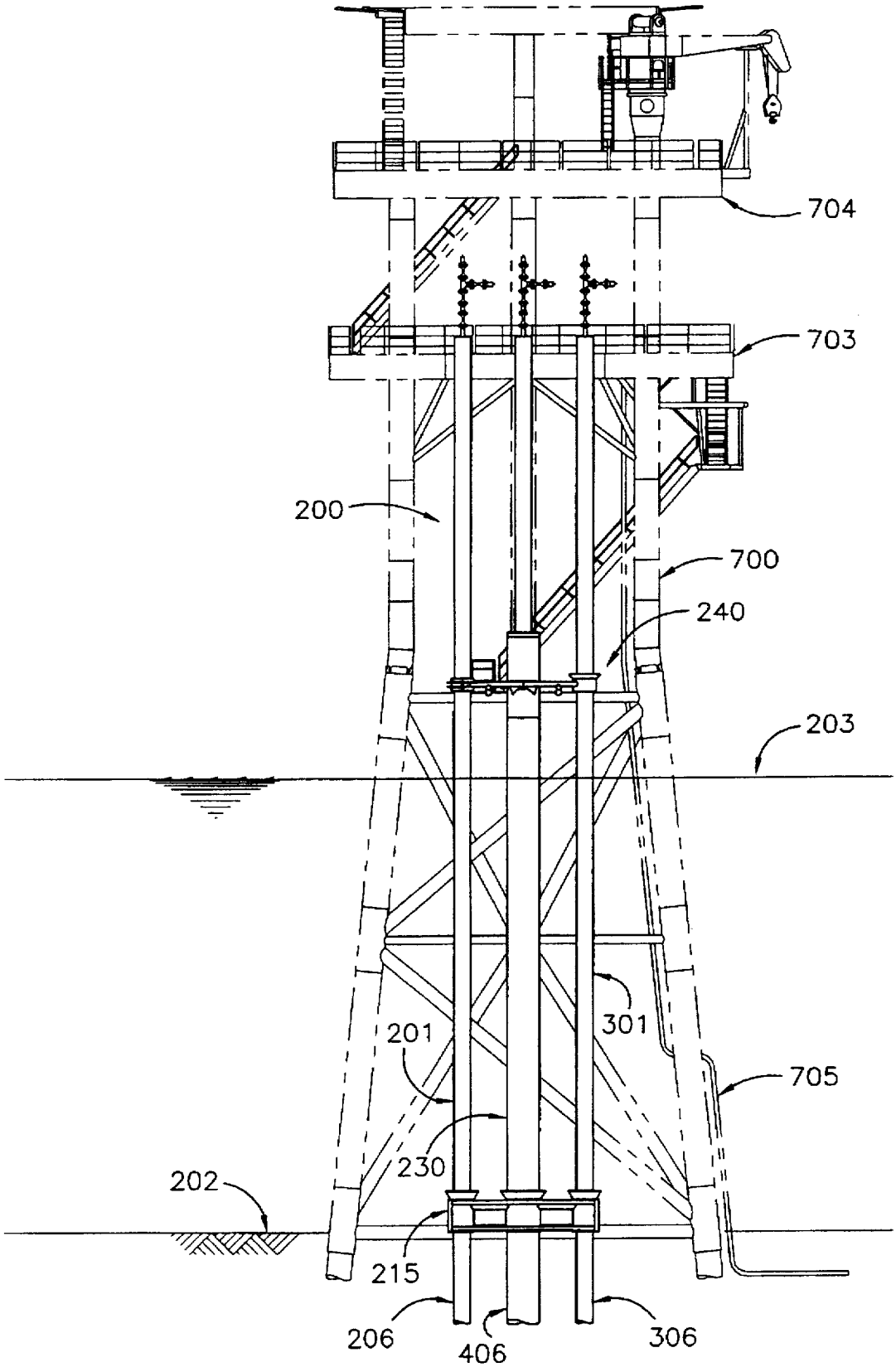
FIG. 11 is a front view of the support structure of FIG. 8, including a conventional jacket structure shown in phantom lines.
Figure 12:
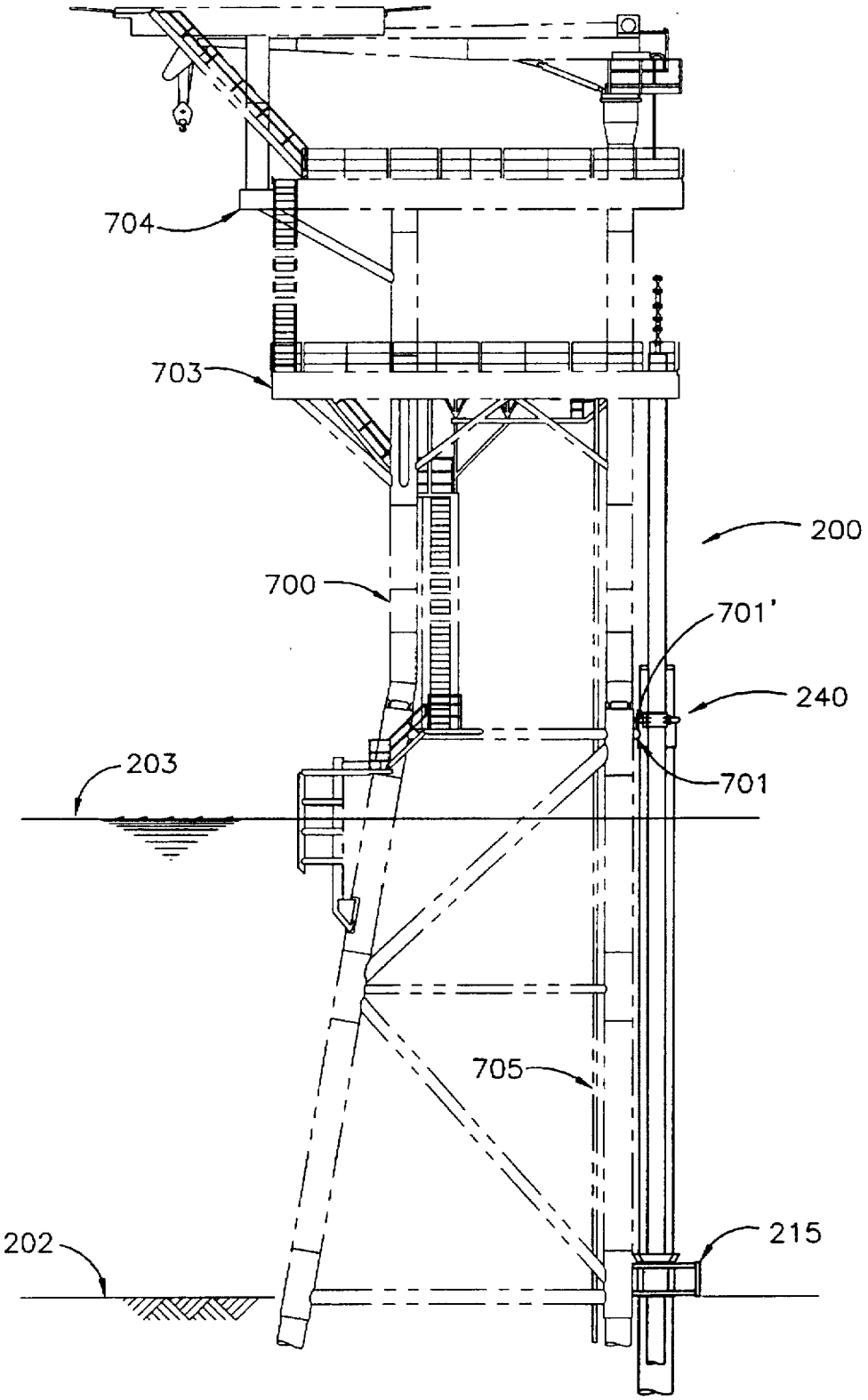
FIG. 12 is a side view of the support structure of the present invention of FIG. 11, with the jacket structure shown in phantom lines.

With reference to FIGS. 11 and 12, once it has been determined to place wells 206, 306, and/or 406 in production, a conventional jacket structure 700 may be installed adjacent the first and second conductors 201, 301, and caisson 230, and the jacket structure 700 may be fixedly secured to the caisson 230, as by any suitable connection means 701 such as by welding a doubler plate 701' or a conventional clamp (not shown). Prior to the installation of jacket structure 700, the boat landing 500 and navigation aids deck 600 could be removed from caisson 230, and the boat landing 500 and navigation aids deck 600 could be subsequently mused in connection with another support structure 200. Jacket structure 700 could have at least one production deck 703 installed upon the jacket structure 700, and if desired a second production deck 704 could also be installed. A conventional sales pipeline 705 would also be installed upon jacket structure 700 in a conventional manner. After jacket structure 700 has been installed, the wells 206, 306, and/or 406 would be perforated in a conventional manner and production of hydrocarbons from the wells 206, 306, and/or 406 could begin.

Figure 16:
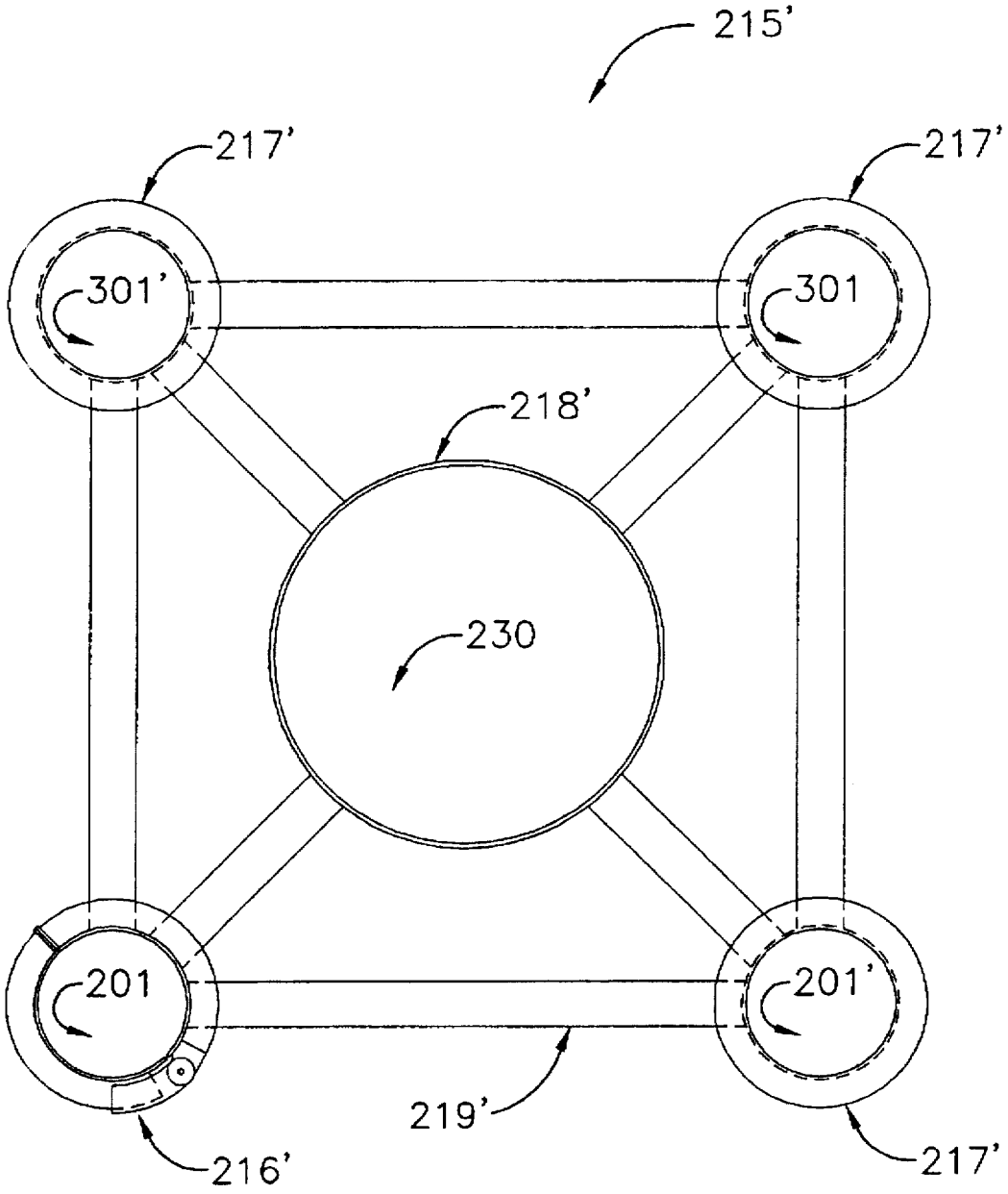
FIGS. 16–18 are top views of other embodiments of subsea templates, in accordance with the present invention.
Figure 17:
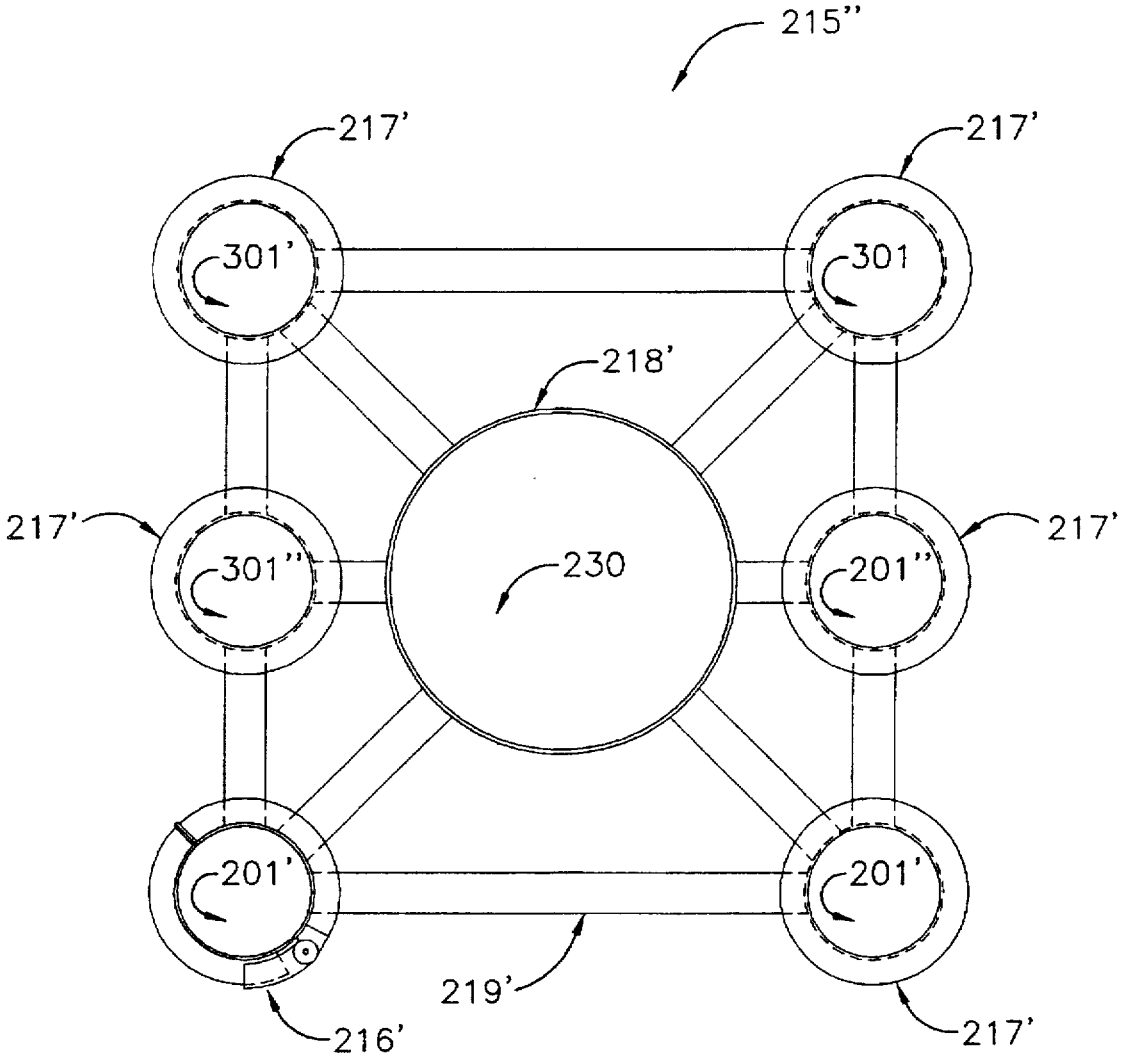
Figure 18:
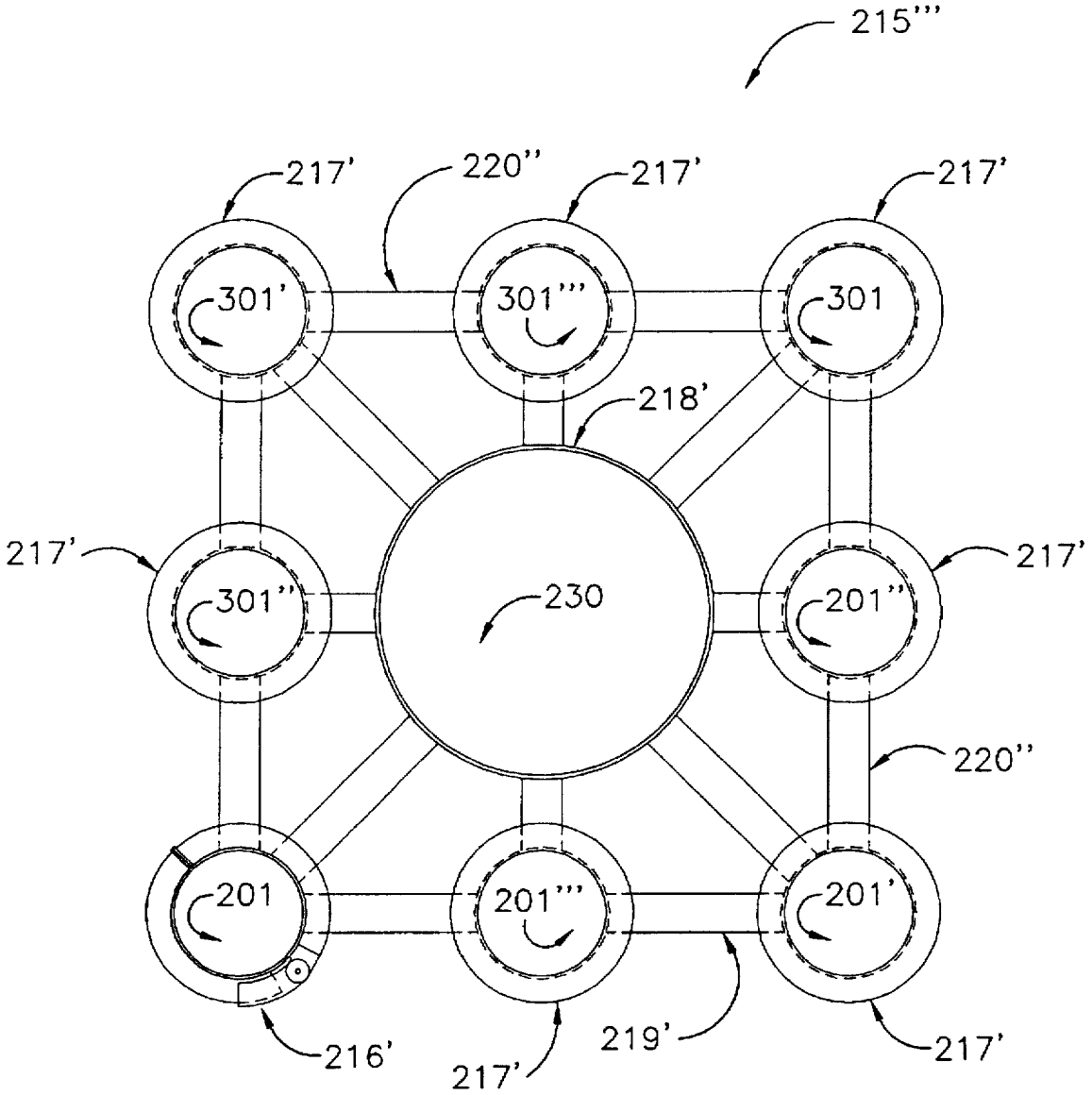

With reference to FIGS. 16–18, other embodiments of subsea template 215 are illustrated. Subsea template 215' of FIG. 16 includes caisson guide member 218', which is of the same construction as that illustrated in FIG. 15, and four conductor guide members 216' 217'. The conductor guide members 216', 217' and caisson guide member 218, are inner-connected by framework 219', in the same manner as previously described in connection with the subsea template 215 of FIG. 15. Conductor guide member 216' has the same construction as conductor guide member 216 of subsea template 215, and the three conductor guide members 217' have the same construction as conductor guide member 217 of FIG. 16. Subsea template 215' could be substituted for subsea template 215 in FIG. 3, and after subsea template 215' has been installed on the ground adjacent the lower end of the first conductor 201, caisson 230 would be installed in the manner previously described in connection with FIG. 4. Three additional conductors 301, 201' and 301' could be installed as previously described in connection with FIGS. 5 and 6, whereby four wells could be provided within the four conductors. An additional well could also be disposed within caisson 230. In this regard, guide frame 240 of FIGS. 13 and 14 would be provided with an additional two conductor guides 241' to provide conductor guides for the third and fourth conductors 201' and 301 '. As with the support structure of FIG. 6, the longitudinal axes of the caisson 230 and the conductors 201, 301, 201' and 301', would be disposed substantially parallel to each other, and the longitudinal axes of caisson 230 and first and second conductors 201, 301 would be substantially coplanar, as well as the longitudinal axes of caisson 230 and third and fourth conductors 201' and 301' would also be substantially coplanar. In a similar manner, the subsea templates 215" and 215'" of FIGS. 17 and 18 would permit, respectively, supporting six conductors and eight conductors, in order to provide an additional corresponding number of wells. Similarly, guide frame 240 would be provided with an additional number of conductor guides, to correspond to the desired number of conductors used in the subsea templates 215" and 215'".

It is to be understood that the invention is not limited to the exact details of construction, operation, exact materials or embodiments shown and described, as obvious modifications and equivalents will be apparent to one skilled in the art; for example, the diameters of the conductors could be the same as that of the caisson, as well as three or five conductors could be disposed in a symmetrical, spaced relationship with respect to the caisson. Accordingly, the invention is therefore to be limited only by the scope of the appended claims.

We claim:

1. A method for providing and supporting at least two wells in the ground beneath a body of water, comprising the steps of:

(a) installing a first conductor, having an upper and a lower end, in the ground, with the first conductor extending from below the ground to above the body of water;

(b) drilling a first well through the first conductor to provide the first well;

(c) installing a subsea template on the ground adjacent the lower end of the first conductor;

(d) installing a caisson, having an upper and a lower end, in the ground, the caisson extending from the ground, through the subsea template, to above the body of water;

(e) attaching a guide frame to the caisson and the first conductor, proximate the upper ends of the caisson and the first conductor, the guide frame including at least one conductor guide;

(f) installing a second conductor, having an upper end and a lower end, in the ground, by passing the second conductor through the at least one conductor guide and the subsea template, with the second conductor extending from the ground to above the body of water;

(g) drilling a second well through the second conductor to provide the second well; and (h) maintaining the at least two wells in the body of water for a period of time, with the at least two wells being supported without any piles or brace members, and being supported solely by the first and second conductors, the caisson, and the guide frame.

2. The method of claim 1, including the step of releasably attaching a boat landing to the caisson.

3. The method of claim 2 wherein the boat landing is releasably attached to the caisson by utilizing a releasable connection means associated with the guide frame and the boat landing.

4. The method of claim 1, including the step of releasably attaching a navigation aids deck to the caisson.

5. The method of claim 1, including the step of drilling a third well through the caisson.

6. The method of claim 1, wherein the subsea template is installed by disposing the subsea template about the upper end of the first conductor and lowering the subsea template until it lies upon the ground adjacent the first conductor.

7. The method of claim 6, wherein the subsea template is disposed about the upper end of the first conductor by providing the subsea template with a first conductor guide member which surrounds the upper end of the first conductor.

8. The method of claim 7, including the steps of clamping the first conductor guide member about the upper end of the first conductor and permitting relative motion between the first conductor guide member and the first conductor as the subsea template is lowered to the ground.

9. The method of claim 7, including the step of providing the subsea template with a second conductor guide member through which the lower end of the second conductor passes.

10. The method of claim 1, including the steps of providing the subsea template with a plurality of conductor guide members; providing the guide frame with a plurality of conductor guides; installing an additional number of conductors, having upper and lower ends, extending from the ground to above the body of water, each of the additional conductors being installed by passing the lower end of each conductor first through a conductor guide of the guide frame and then through a conductor guide member of the subsea template; and drilling an additional number of wells through the additional conductors to provide additional wells.

11. The method of claim 1, including the steps of: after the passage of the period of time, installing a jacket structure adjacent to the first and second conductors and caisson; and fixedly securing the jacket structure to the caisson.

12. The method of claim 11, including the step of installing at least one production deck to the jacket structure.

13. A support structure for use with at least two wells in the ground beneath a body of water, comprising:

(a) at least two conductors, each conductor having a diameter, an upper end, and a lower end, each conductor adapted to extend from the ground to above the body of water and the at least two wells are adapted to be disposed within the at least two conductors;

(b) a caisson, having a diameter, an upper end, and a lower end, and adapted to extend from the ground to above the body of water, the caisson being disposed between, and in a spaced relationship with, the at least two conductors, and the at least two conductors and caisson being disposed substantially perpendicular to the ground;

(c) a subsea template disposed on the ground proximate the lower ends of the caisson and the at least two conductors, the subsea template adapted to be disposed on the ground without being secured to the ground with one or more piles, and includes a conductor guide member for each of the at least two conductors, and a caisson guide member for the caisson, with at least two conductors being disposed within the conductor guide members proximate the lower ends of the at least two conductors, and the caisson being disposed within the caisson guide member proximate the lower end of the caisson;

(d) a guide frame fixedly secured to the caisson and disposed proximate the upper ends of the caisson and the at least two conductors, the guide frame including a conductor guide for each of the at least two conductors, the at least two conductors being disposed within the conductor guide proximate the upper ends of the at least two conductors; and (e) the caisson and the at least two conductors not including any piles or brace members, whereby the at least two wells are adapted to be supported in the body of water solely by the caisson, the at least two conductors, and the guide frame.

14. The support structure of claim 13, including a boat landing attached to the caisson.

15. The support structure of claim 14, wherein the guide frame and the boat landing includes a means for releasably attaching the boat landing to the caisson.

16. The support structure of claim 13, including a navigation aids deck attached to the caisson.

17. The support structure of claim 16, wherein the navigation aids deck includes a means for releasably attaching the navigation aids deck to the caisson.

18. The support structure of claim 13, wherein at least one of the conductor guide members includes a means for clamping the at least one conductor guide member to one of the conductors.

19. The support structure of claim 13, wherein the at least two conductors and the caisson each have a longitudinal axis, and the longitudinal axes of the at least two conductors and the caisson are substantially coplanar.

20. The support structure of claim 13, wherein the diameter of the caisson is larger than the diameter of each of the at least two conductors.

* * * * *